US006216505B1

(12) United States Patent
Hiramatsu et al.

(10) Patent No.: US 6,216,505 B1
(45) Date of Patent: Apr. 17, 2001

(54) METHOD AND APPARATUS FOR ROLLING A STRIP

(75) Inventors: Shinichiro Hiramatsu, Osaka; Ryuji Hamada, Ibaraki, both of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/598,903

(22) Filed: Jun. 22, 2000

(30) Foreign Application Priority Data

Jun. 25, 1999 (JP) ..... 11-179442

(51) Int. Cl.[7] ..... B21B 37/28

(52) U.S. Cl. ..... 72/11.7; 72/9.1; 72/241.6; 72/366.2

(58) Field of Search ..... 72/9.1, 11.7, 201, 72/241.6, 241.8, 366.2

(56) References Cited

U.S. PATENT DOCUMENTS 3,731,508 * 5/1973 Sabatini et al. ..... 72/9.1
4,537,050 * 8/1985 Bryant et al. ..... 72/9.1
4,633,693 1/1987 Tahara et al. .
4,726,213 * 2/1988 Manchu ..... 72/9.1
4,912,956 * 4/1990 Matricon et al. ..... 72/11.7
5,235,835 * 8/1993 Sakai et al. ..... 72/9.1

FOREIGN PATENT DOCUMENTS 57-103719 6/1982 (JP) .
60-206511 10/1985 (JP) .

OTHER PUBLICATIONS

"The Variable Crown Roll—VC Roll" brochure, Sumitomo Metal, Railway, Automotive & Machinery Parts Division (undated).

* cited by examiner

*Primary Examiner*—Ed Tolan
(74) *Attorney, Agent, or Firm*—Clark & Brody

(57) ABSTRACT

A method and apparatus for rolling a strip by a rolling mill wherein one back-up roll of the pair of back-up rolls is a variable crown roll having a single oil chamber and the other back-up roll is a variable crown roll having a plurality of oil chambers. The strip shape is detected by a shape meter and approximated by a power function which includes terms of the first, second, fourth, and sixth powers of a distance measured from the center in the width direction and then precisely controlled by a calculation and control unit based on the obtained power function.

12 Claims, 9 Drawing Sheets

ELONGATION
g(x)

ELONGATION
fi(x)

ELONGATION f1(x) = Bi x f2(x) = Ci x2 f4(x) = Di x4 f6(x) =Fi x6
13
OUTPUT SIGNAL FOR L&R PRESSING FORCE CONTROL
14
OUTPUT SIGNAL FOR SVC ROLL FORCE CONTROL
17
OUTPUT SIGNAL FOR MVC ROLL FORCE CONTROL
15
OUTPUT SIGNAL FOR BENDING FORCE CONTROL
16
OUTPUT SIGNAL FOR ROLL COOLANT FLOW RATE CONTROL

METHOD AND APPARATUS FOR ROLLING A STRIP

This application claims priority under 35 U.S.C. § § 119 and/or 365 to Japan Patent Application No. 11-179442 filed in Japan on Jun. 25, 1999, the entire content of which is herein incorporated by reference.

BACKGROUND OF THE INVENTION

1. Field of the Invention

The present invention relates to a method and apparatus for rolling a strip. More particularly, the present invention relates to a method and apparatus for rolling a strip, which method or apparatus enables reliable rolling of uniform quality for producing thin strips, including foils having good shape.

As used herein, the term "shape" refers to surface shape and the term "good shape" refers to the surface of a strip in which uneven stretching has been suppressed, such as so-called center buckling in which stretching of a central portion of a strip in the width direction is greater than that of the edges; a so-called wavy edge in which stretching of the strip edges is greater than that of a central portion; and so-called quarter buckling in which stretching of outer quarter portions in the width direction of the strip is greater than that of the center and edges.

2. Related Background Art

Typically, a 4-hi rolling mill which has left and right pressing-down balancers, roll benders, and roll coolants is widely used for rolling strips of various metals. When such a rolling mill is employed, the shape of the strip is regulated by approximating the strip shape in the width direction by use of a power function and matching the strip shape to a target shape based on the approximation by means of the pressing-down balancers disposed on both the left and the right sides, the roll benders, and the roll coolants.

Japanese Patent Publication (kokoku) No. 20171/1993 discloses a method for regulating the strip shape in which a variable crown roll having a single oil chamber serves as a back-up roll and a strip shape in the width direction detected by a shape detector is approximated by a function including terms of the first, second, and fourth (or sixth) powers of a distance measured from the center of the width, each term of the power function being controlled to match a corresponding target value. Specifically, the term of the first power is controlled by adjusting the amount of the left and right pressing down (hereinafter called "pressing-down amount"); the term of the second power by adjusting the roll crown of the variable crown roll having a single oil chamber; the term of the fourth power or the term of the sixth power by adjusting the bending force of a roll bender.

However, when a rolling apparatus employing a small-diameter work roll having a ratio of barrel length L to diameter D (L/D) is more than 4, such as a rolling apparatus employed for rolling thin strips such as aluminum foil, controlling the term of the fourth power is substantially difficult, because portions effectively controlled by a roll bender are limited to the ends of the roll.

In addition, when a thin strip having an exit-side-thickness as low as about 30 $\mu$m or less is rolled, ends of the upper and lower work rolls come into contact with each other at their end portions, due to the small thickness of strip. In such a situation, a work roll bender which controls the strip shape by utilizing the bending force of a work roll does not function effectively.

In this case, control by roll coolants is more important. However, roll coolants disadvantageously require a warm-up process prior to rolling, and in addition, the performance thereof is unsatisfactory and response during operation is poor.

Therefore, the conventional controlling schemes involve problems that sufficient control precision cannot be attained, particularly in the rolling of thin strips such as foil.

SUMMARY OF THE INVENTION

In view of the foregoing, an object of the present invention is to provide a method for rolling a strip, which method is easy to carry out, ensures good response, and enables shape control of high precision, even when a strip is rolled by means of a rolling apparatus employing a small-diameter work roll having a ratio of barrel length L to diameter D (L/D) is more than 4. Another object of the invention is to provide a rolling apparatus employed for attaining the above object.

Accordingly, the present invention provides a method for rolling a strip by means of a rolling mill having a pair of work rolls and a pair of back-up rolls for supporting the work rolls, wherein one back-up roll of the pair of back-up rolls is a variable crown roll having a single oil chamber, and the other back-up roll is a variable crown roll having a plurality of oil chambers; the method comprising:

detecting a strip shape in the width direction;

approximating the detected strip shape by a power function which includes terms of second and fourth powers of a distance measured from the center of the width;

adjusting the term of second power by controlling the roll crown of the variable crown roll having a single oil chamber so as to match a target value; and adjusting the term of the fourth power by controlling the roll crown of the variable crown roll having a plurality of oil chambers so as to match a target value.

The present invention also provides a method for rolling a strip by means of a rolling mill having a pair of work rolls; a pair of back-up rolls for supporting the work rolls; left and right pressing-down balancers; roll benders; and roll coolants, wherein one back-up roll of the pair of back-up rolls is a variable crown roll having a single oil chamber, and the other back-up roll is a variable crown roll having a plurality of oil chambers; the method comprising:

detecting a strip shape in the width direction;

approximating the detected strip shape by a power function which includes terms of the first, second, fourth, and sixth powers of a distance measured from the center of the width;

adjusting the term of the first power by controlling the pressing-down amount of the left and right pressing-down balancers so as to match a target value;

adjusting the term of the second power by controlling the roll crown of the variable crown roll having a single oil chamber so as to match a target value;

adjusting the term of the fourth power by controlling the roll crown of the variable crown roll having a plurality of oil chambers so as to match a target value;

adjusting the term of the sixth power by controlling the roll bending force of the roll benders so as to match a target value; and controlling the roll coolants so as to obtain an elongation corresponding to the difference between the detected strip shape and a target shape which is approximated by the power function.

In these methods for rolling a strip, as an example of a work roll, there is a work roll having a small diameter with a ratio of barrel length L to diameter D (L/D) of more than 4.

In these methods for rolling a strip, a variable crown roll having two oil chambers may serve as the variable crown roll having a plurality of oil chambers.

In another aspect of the present invention, there is an apparatus for rolling a strip, which apparatus comprises a rolling mill, a shape meter, and a calculation and control unit, wherein the rolling mill comprises a pair of work rolls; a pair of back-up rolls for supporting the work rolls; left and right pressing-down balancers; roll benders; and roll coolants;

one back-up roll of the pair of back-up rolls is a variable crown roll having a single oil chamber and the other back-up roll is a variable crown roll having a plurality of oil chambers;

the shape meter is disposed at the entrance or exit of the rolling mill to detect a strip shape in the width direction;

the calculation and control unit approximates the strip shape detected by the shape meter by a power function which includes terms of the first, second, fourth, and sixth powers of a distance measured from the center of the width;

the calculation and control unit calculates the following control amounts:

the control amount of the pressing-down amount of the left and right pressing-down balancers so as to match a target value of the term of the first power;

the control amount of the roll crown of the variable crown roll having a single oil chamber so as to match a target value of the term of the second power;

the control amount of the roll crown of the variable crown roll having a plurality of oil chambers so as to match a target value of the term of the fourth power;

the control amount of the roll bending force of the roll benders so as to match a target value of the term of sixth power; and the control amount of the roll coolants so as to obtain an elongation corresponding to the difference between the strip shape detected by the shape meter and a target shape which is approximated by the power function.

In these rolling apparatus for rolling a strip, as an example of a work roll, there is a work roll having a small diameter with a ratio of barrel length L to diameter D (L/D) of more than 4.

In this apparatus for rolling a strip, a variable crown roll having two oil chambers may serve as the variable crown roll having a plurality of oil chambers.

In the present invention, thin metal strips, including foil, are preferably adapted to rolling. Particularly, foil can be rolled to obtain a controlled shape with high precision.

BRIEF DESCRIPTION OF THE DRAWINGS

FIGS. 4A and 4B are charts showing an elongation change characteristics with employment of right and left pressing-down balancers, wherein FIG. 4A shows the case of a narrow strip having a width of 1100 mm or less and FIG. 4B shows the case of a wide strip having a width of 1500 mm or more;

FIGS. 5A and 5B are charts showing elongation change characteristics with employment of an SVC roll, wherein FIG. 5A shows the case of a narrow strip having a width of 1100 mm or less and FIG. 5B shows the case of a wide strip having a width of 1500 mm or more;

FIGS. 6A and 6B are charts showing elongation change characteristics with employment of an MVC roll, wherein FIG. 6A shows the case of a narrow strip having a width of 1100 mm or less and FIG. 6B shows the case of a wide strip having a width of 1500 mm or more;

FIGS. 7A and 7B are charts showing elongation change characteristics with employment of roll benders, wherein FIG. 7A shows the case of a narrow strip having a width of 1100 mm or less and FIG. 7B shows the case of a wide strip having a width of 1500 mm or more;

DETAILED DESCRIPTION

The present inventors have carried out experiments, and FIGS. 4 to 7, respectively, show the profiles of elongation change with employment of left and right pressing-down balancers; with employment of a variable crown roll having a single oil chamber; with employment of a variable crown roll having two oil chambers; and with employment of roll benders. Hereinafter, the term "variable crown roll having a single oil chamber" is referred to as an SVC roll and term "variable crown roll having two oil chambers" is referred to as an MVC roll.

FIGS. 4 to 7 show elongation change characteristics with employment of left and right pressing-down balancers; an SVC roll; an MVC roll; and roll benders, respectively. FIGS. 4A to 7A show the case of a narrow strip having a width of 1100 mm or less and FIGS. 4B to 7B show the case of a wide strip having a width of 1500 mm or more. In each of these figures, the X-axis represents distance in the width direction with the center being equal to 0 (two edges represented by +1 and −1), and the Y-axis represents elongation change.

As is clear from FIGS. 4 to 7, an elongation change characteristic with employment of left and right pressing-down balancers is represented by an equation of the first power of x, x being the distance from the center in the width direction; an elongation change characteristic with employment of an SVC roll is represented by an equation of the second power of x; an elongation change characteristic with employment of an MVC roll is represented by an equation of the fourth power of x, and an elongation change characteristic with employment of roll benders is represented by an equation of the sixth power of x, regardless of the width of strips.

Figure 8A:
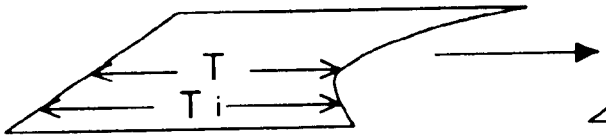
FIG. 8A and FIG. 8B are charts for describing the concept of elongation change.
Figure 8B:
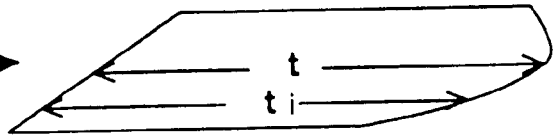

As shown in FIG. 8A and FIG. 8B, the elongation change is obtained from the difference between Ei and ei wherein Ei and ei represent elongation before and after operation by means of left and right balancers, an SVC roll, an MVC roll, and roll benders, respectively. The elongation Ei and ei are provided by the following equations (1) and (2):

$$Ei=(T-Ti)/T \quad (1)$$

$$ei=(t-ti)/t \quad (2)$$

wherein each of T and t represents the length at a reference position such as the center in the width direction before or after the aforementioned operations, and each of Ti and ti represents the length at an arbitrary position.

If the shape in the width direction; i.e., the strip shape, detected by a shape meter is represented by a certain function g(x), the function is approximated on the basis of elongation changes represented by terms of the first power, second power, fourth power, and sixth power, respectively, to the following power function fi(x):

$$fi(x)=Ai+Bi(x)+Ci(x)^2+Di(x)^4+Fi(x)^6 \quad (3)$$

wherein Ai to Fi are coefficients. These terms correspond to elongation change characteristics with employment of left and right pressing-down balancers, an SVC roll, an MVC roll, and roll benders, respectively.

A target shape is also represented by a similar power function fo(x):

$$fo(x)=Ao+Bo(x)+Co(x)^2+Do(x)^4+Fo(x)^6 \quad (4).$$

Then, the pressing-down amounts of the left and right pressing-down balancers, the roll crown of the SVC roll, the roll crown of the MVC roll, and roll bending force are controlled so as to match Bi through Fi with the target values Bo through Fo.

The flow rate of each nozzle of roll coolants is adjusted so as to obtain an elongation change corresponding to the aforementioned difference between g(x) and fo(x).

The present invention will next be described by way of working examples with reference to FIGS. 1 to 3.

Figure 1:
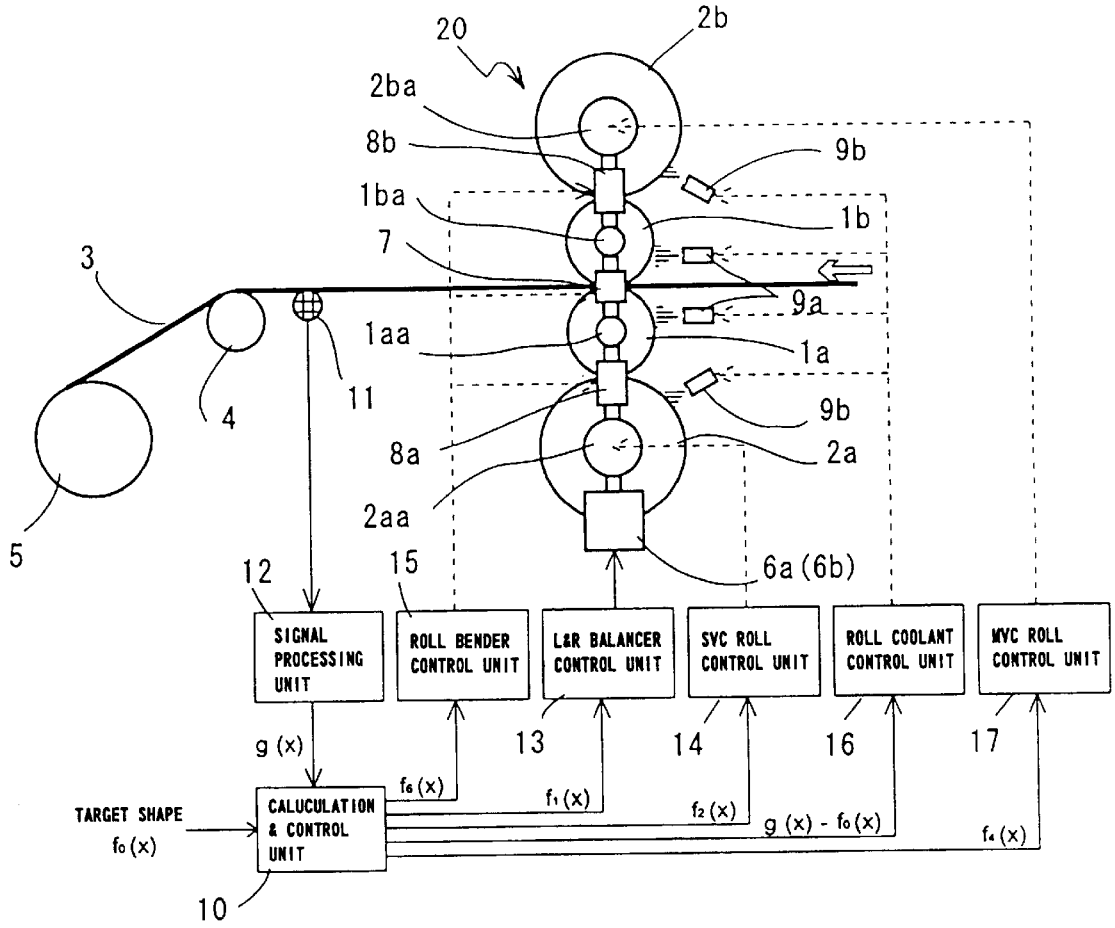
FIG. 1 is a schematic view showing a working example employing an apparatus and method for rolling a strip according to the present invention.
Figure 2A:
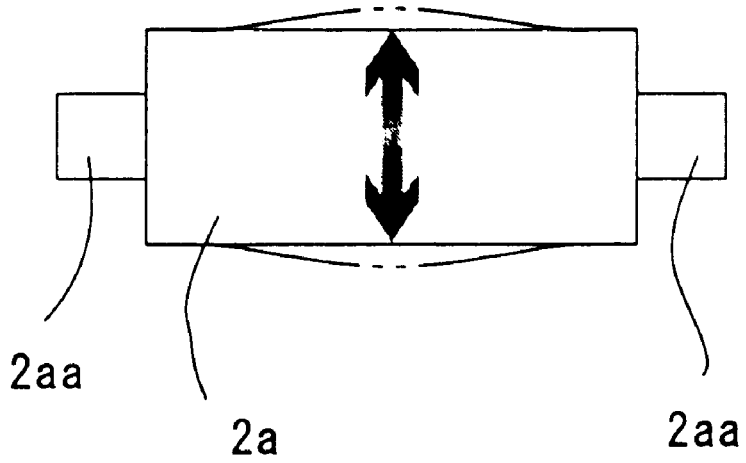
FIG. 2A is a schematic view of variation in a crown of an SVC roll and FIG. 2B is a schematic view of variation in a crown of an MVC roll.
Figure 2B:
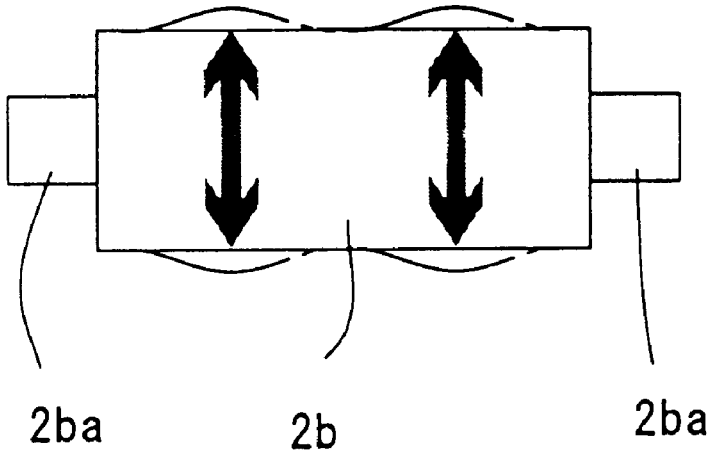

FIG. 1 is a schematic view showing a working example employing an apparatus and method for rolling a strip according to the present invention. FIG. 2A is a schematic view of variation of a crown of an SVC roll, and FIG. 2B is a schematic view of variation of a crown of an MVC roll.

In FIG. 1, reference numerals 1*a* and 1*b* denote work rolls; reference numeral 2*a* denotes a back-up roll formed of an SVC roll; reference numeral 2*b* denotes a back-up roll formed of an MVC roll; and reference numeral 3 denotes a strip to be rolled. As is shown with an arrow, the strip 3 is pressed with work rolls 1*a* and 1*b* and wound up by a reel 5 via a guide roll 4.

The rolling apparatus comprises a rolling mill 20, a shape meter 11, and a calculation and control unit 10. The rolling mill 20 comprises the work rolls 1*a* and 1*b*, the back-up rolls 2*a* and 2*b*, left and right pressing-down balancers 6*a* and 6*b*, roll benders 7, 8*a*, and 8*b*, and roll coolants 9*a* and 9*b*.

The work rolls 1*a* and 1*b* may be small-diameter work rolls having a ratio of barrel length L to diameter D (L/D) of more than 4.

The back-up roll 2*a* is inflated; i.e., pressurized oil is supplied from a roll shaft portion 2*aa* to a portion between the roll shaft portion 2*aa* and a concentrically arranged roll sleeve, thereby inflating the sleeve as indicated by an imaginary line in FIG. 2A. Thus, the roll is converted to a variable crown roll having a single oil chamber in which a roll crown at the central portion is adjustable.

The back-up roll 2*b* is inflated; i.e., pressurized oil is supplied from a roll shaft portion 2*ba* to a portion between the roll shaft portion 2*ba* and a concentrically arranged roll sleeve, thereby inflating the sleeve as indicated by an imaginary line in FIG. 2B. Thus, the roll is converted to a variable crown roll having two oil chambers in which roll crowns at quarter portions of the roll are adjustable.

Pressing-down balancers 6*a* and 6*b*, which are driven independently, are disposed at both (only one balancer is shown in the figure) end portions of the roll shaft 2*aa* of the back-up roll 2*a*. Similarly, roll benders 7, 8*a*, and 8*b* are disposed between the roll shaft 1*aa* of the work roll 1*a* and the roll shaft 1*ba* of the work roll 1*b*; between the roll shaft laa of the work roll 1*a* and the roll shaft 2*aa* of the back-up roll 2*a*; and between the roll shaft 1*ba* of the work roll 1*a* and the roll shaft 2*ba* of the back-up roll 2*b*, respectively. In addition, roll coolants 9*a* and 9*b* oppositely facing the surfaces of work rolls 1*a* and 1*b* and back-up rolls 2*a* and 2*b* are disposed, each roll coolant comprising a plurality of nozzles arranged on a line, each nozzle allowing flow control of cooling water.

The pressing-down balancers 6*a* and 6*b* control the pressing-down amounts at left and right end portions of the back-up roll 2*a*, thereby modifying a roll gap in the direction of the shafts of work rolls 1*a* and 1*b*; adjusting the elongation of the strip 3 in the width direction; and correcting the strip shape.

The roll benders 7, 8*a*, and 8*b* modify the shape of work rolls, thereby adjusting the elongation of the strip 3 at different positions in the width direction and correcting the strip shape. Specifically, the lengths of hydraulic cylinders are changed such that the distance between the roll shaft 1*aa* of the work roll 1*a* and the roll shaft 1*ba* of the work roll 1*b*; the distance between the roll shaft 1*aa* of the work roll 1*a* and the roll shaft 2*aa* of the back-up roll 2*a*; or the distance between the roll shaft 1*ba* of the work roll 1*a* and the roll shaft 2*ba* of the back-up roll 2*b* becomes shorter (decrease direction) or longer (increase direction).

The calculation and control unit 10 reads, through a signal processing unit 12 and at predetermined timing, detected signals of the shape meter 11 disposed, for example, at the exit side, thereby approximating the strip shape on the basis of the detected signals to the aforementioned function fi(x) represented by equation (3), which function should include terms of the first power, the second power, the fourth power, and the sixth power. In addition, the unit 10 provides the predetermined target shape by way of the aforementioned function fo(x) represented by equation (4), which function should include terms of the first power, the second power, the fourth power, and the sixth power. Specifically, the unit 10 calculates the pressing-down amounts of the pressing-down balancers 6*a* and 6*b*; the hydraulic pressure of the back-up rolls 2*a* and 2*b*; and the hydraulic pressure of roll benders 7, 8*a*, and 8*b* required for matching Bi with Bo, Ci with Co, Di with Do, and Fi with Fo. Furthermore, the calculation and control unit 10 calculates the timing and ratio of opening of the nozzles of roll coolants 9*a* and 9*b* required for compensating the difference between g(x) and fo(x); i.e., g(x)−fo(x), thereby outputting control signals to controlling portions 13 to 17.

Figures 3A, 3B, 3C, 3D, 3E, 3F, 3G:
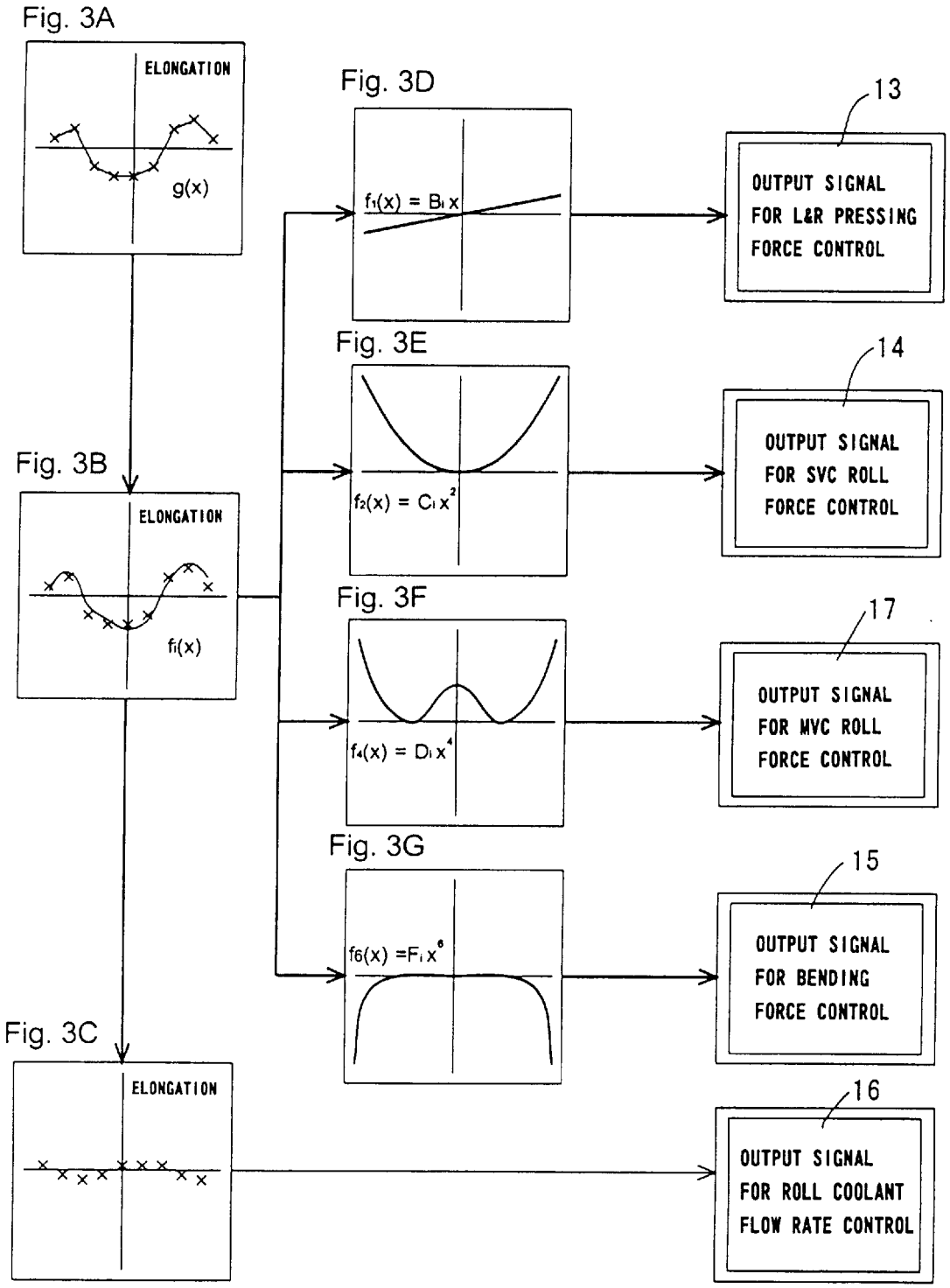
FIG. 3 is a chart showing an example of the shape change in rolling by use of an SVC roll and an MVC roll.
Figure 4A:
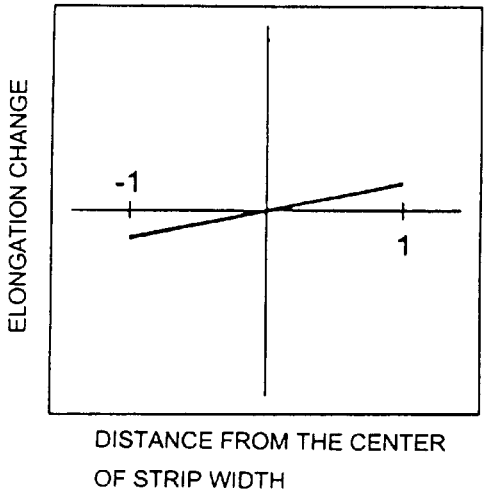
Figure 4B:
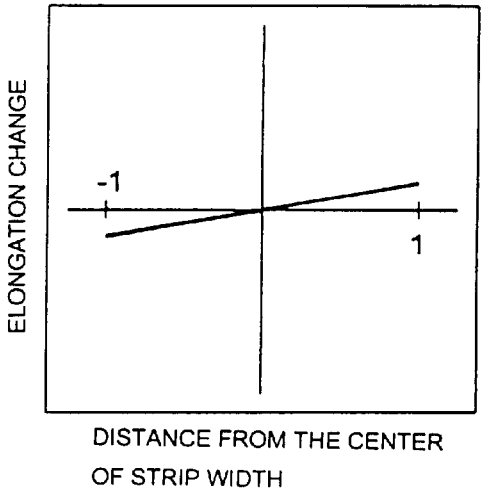
Figure 5A:
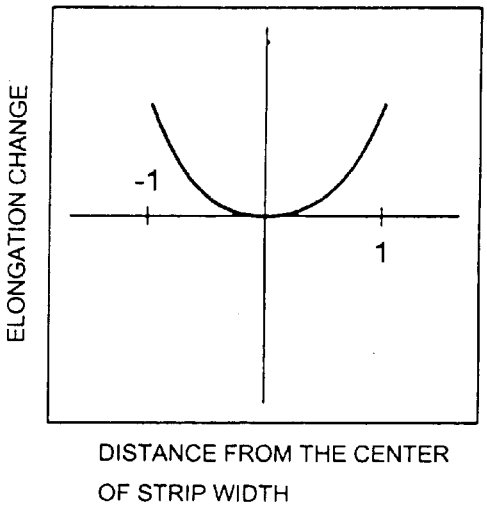
Figure 5B:
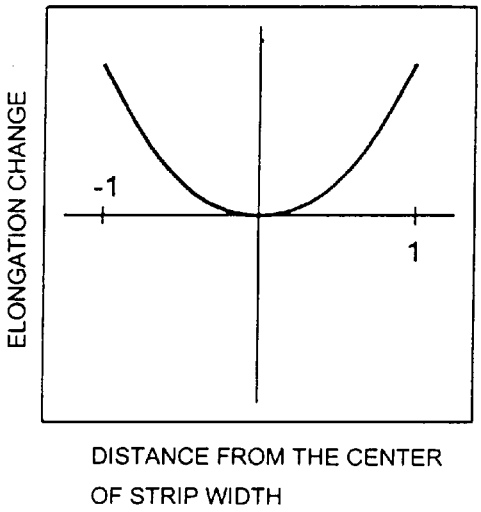
Figure 6A:
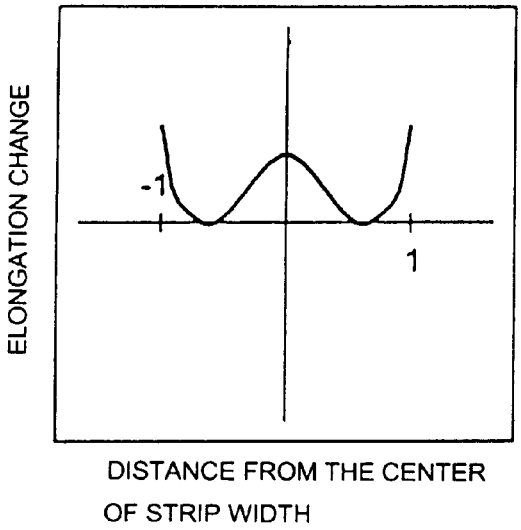
Figure 6B:
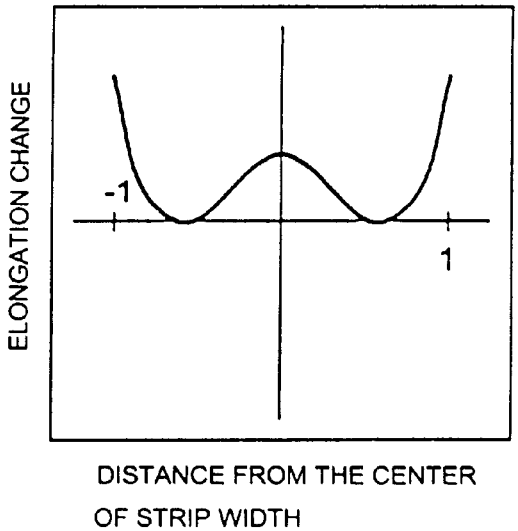
Figure 7A:
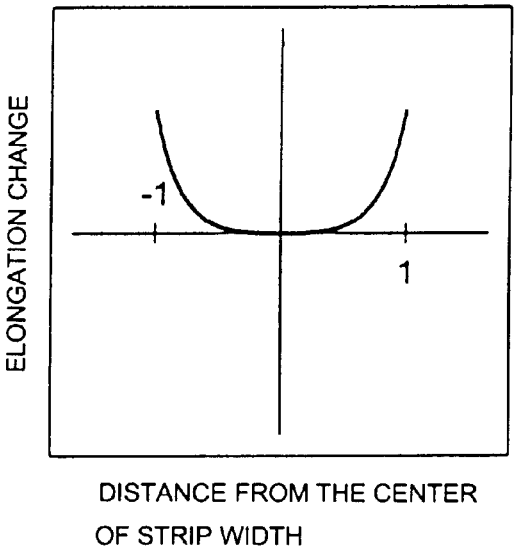
Figure 7B:
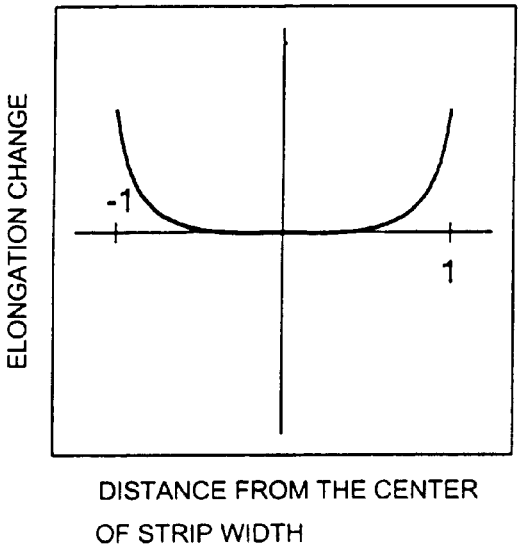

FIG. 3 is a model chart showing the process of shape control according to the method of the present invention and making use of the apparatus of the invention. Firstly, if the shape of the strip 3 in the width direction; i.e., the strip shape, which is detected by the shape meter 11, has a profile as shown in FIG. 3A (referred to as g(x)), g(x) is made to approximate the function fi(x) as shown in FIG. 3B, the X-axis representing strip width and the Y-axis representing elongation.

In FIGS. 3D to 3G, in which the X-axis represents the position from the center of the strip in the width direction and the Y-axis represents percent elongation, the function fi(x) is represented by the sum of a component of the first power, fl(x)=Bi(x); a component of the second power, f2(x)=Ci $(x)^2$; a component of the fourth power, f4(x)=Di$(x)^4$; and a component of the sixth power, f6(x)=Fi$(x)^6$. The power function is compared with the power function fo(x) represented by equation (4) which represents a predetermined target shape, and control signals are output to a control portion 13 of the pressing-down balancers 6*a* and 6*b*; a control portion 14 of the back-up rolls 2*a*; a control portion 17 of the back-up roll 2*b*; and a control portion 15 of the roll benders 7, 8*a*, and 8*b* so as to match Bi of the term of the first power with Bo, Ci of the term of the second power with Co, Di of the term of the fourth power with Do, and Fi of the term of sixth power with Fo. As shown in FIG. 3C, i.e., a graph in which the X-axis represents the position from the center of the strip in the width direction and the Y-axis represents percent elongation, the difference between fo(x) and g(x) is calculated and control signals are output to a control portion 16 of roll coolants 9*a* and 9*b* so as to compensate the difference.

Next, controlling of the strip shape by adjusting the roll crown amounts of an SVC roll and an MVC roll will be described with specific physical quantities. In this embodiment, each of the SVC roll and MVC roll has an outer diameter of 850 mm and a barrel length of 2000 mm, and each work roll has an outer diameter of 280 mm and a barrel length of 2000 mm.

Figure 9:
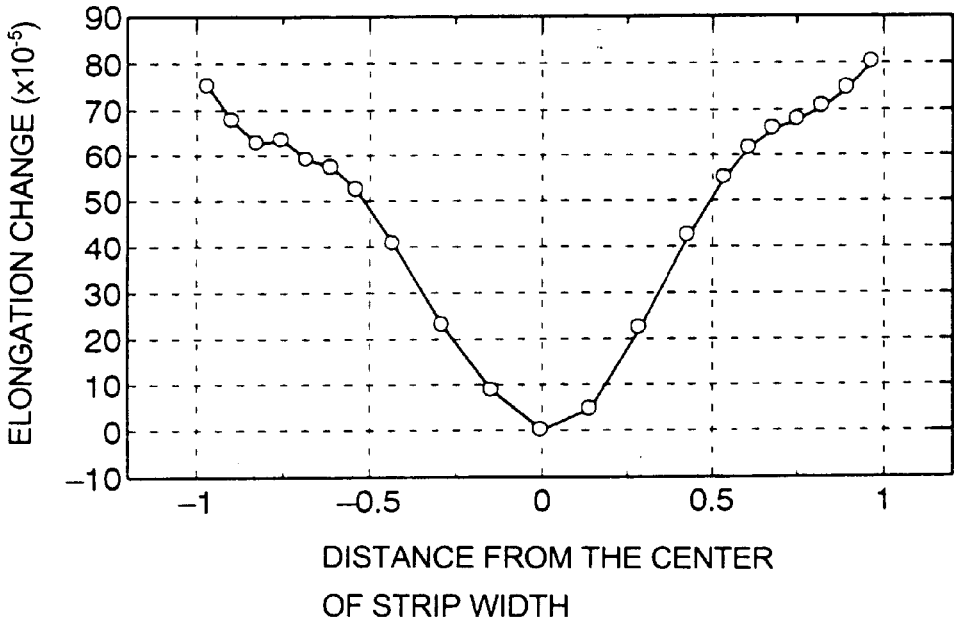
FIG. 9 is a graph showing the elongation change of aluminum foil rolled by means of an SVC roll.
Figure 10:
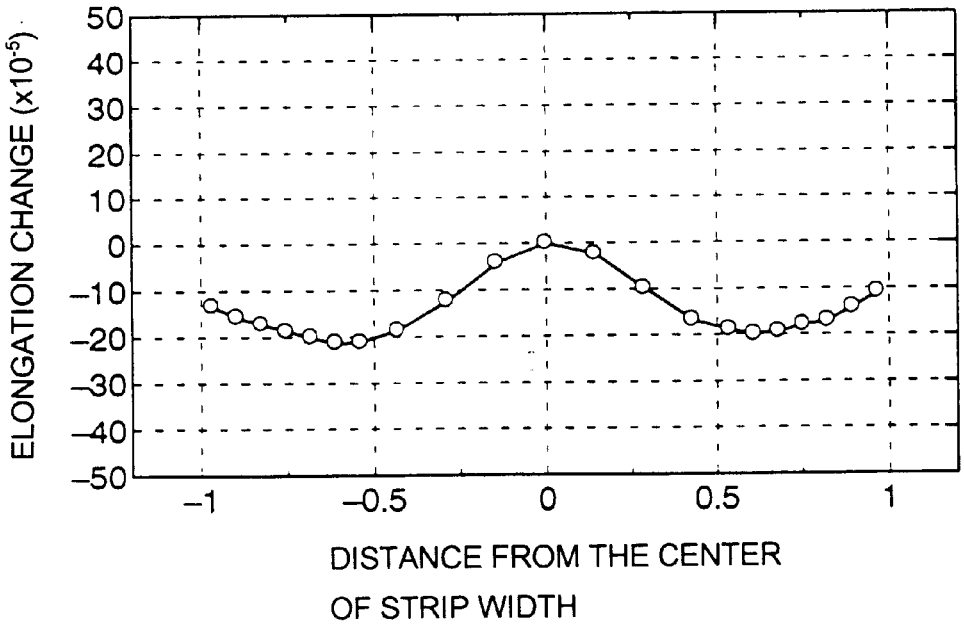
FIG. 10 is a graph showing the elongation change of aluminum foil rolled by means of an MVC roll.

Elongation change characteristics with employment of the aforementioned SVC roll and MVC roll are shown in FIGS. 9 and 10. In these graphs, the X-axis represents the distance from the center of the strip in the width direction, 1 or −1 representing either end, and the Y-axis represents percent elongation. The process of rolling a pure aluminum strip having a width of 1550 mm and a thickness of 28 $\mu$m to a foil having a thickness of 14 $\mu$m is shown in FIGS. 9 and 10.

Figure 11:
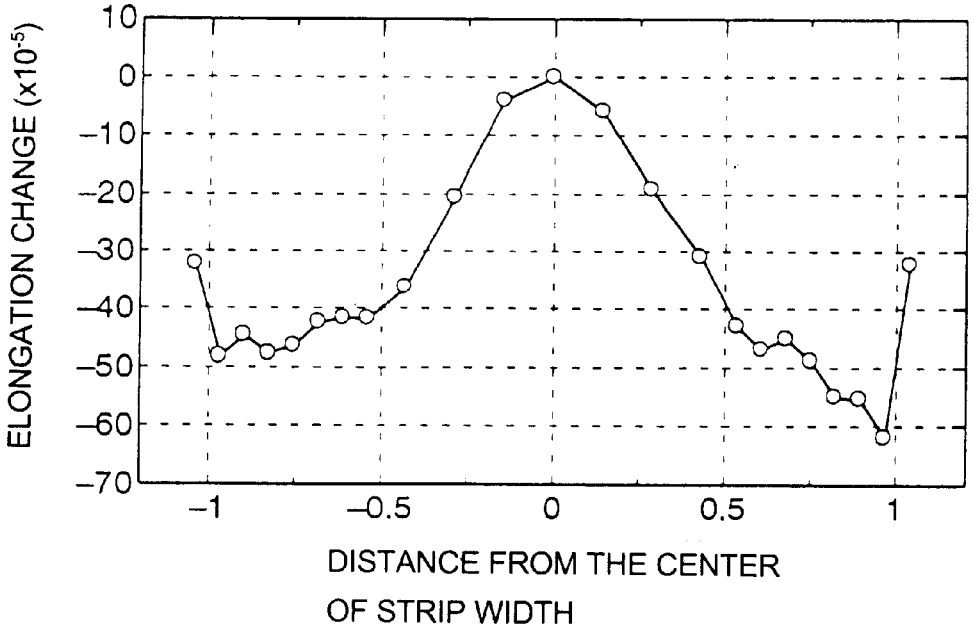
FIG. 11 is a graph showing the distribution of the elongation of a strip in the width direction.

A strip having exhibiting elongation as shown in FIG. 11 was rolled by use of an SVC roll and an MVC roll having the above-described elongation change characteristics, so as to obtain a flat shape in the width direction.

FIG. 11 is a graph showing the distribution, in the width direction, of percent elongation of a strip, wherein the X-axis represents the distance from the center of the strip in the width direction and the Y-axis represents percent elongation. As is clear from the graph, the elongation of the strip increases as the distance from the center in the width direction increases.

Such a strip was rolled under control by adjusting hydraulic pressure of the SVC roll so as to match with a component of the second power of elongation with a target value.

Figure 12:
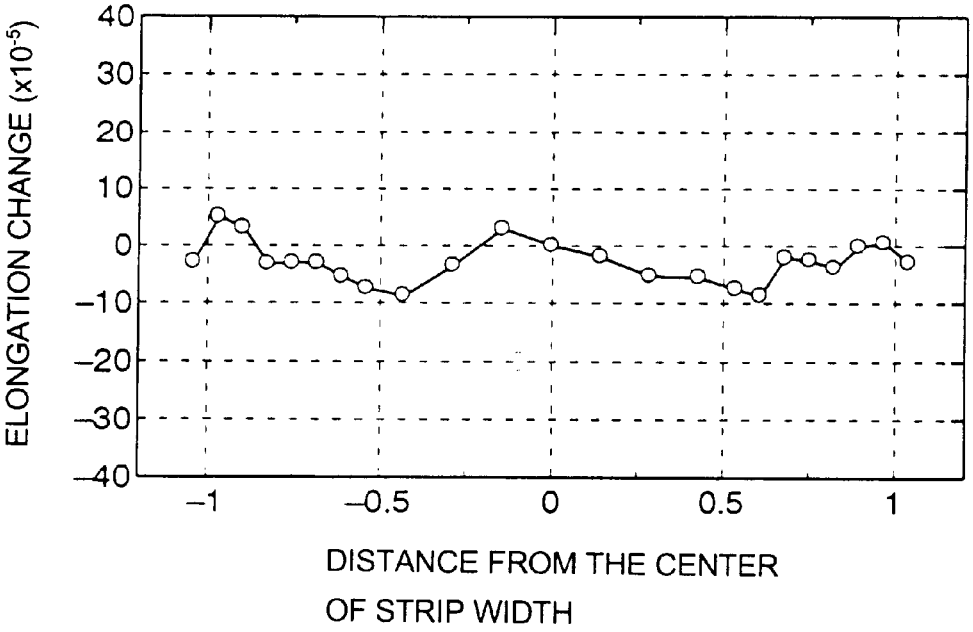
FIG. 12 is a graph showing results of shape control attained by means of an SVC roll.

FIG. 12 is a graph showing results of shape control by means of an SVC roll, wherein the X-axis represents the distance from the center of the strip in the width direction and the Y-axis represents percent elongation. The graph clearly indicates that elongation at the center and elongation at the edge portions similarly decreased, but elongation remained large at portions in an intermediate portion of the center and the edge, i.e., quarter portions.

Thus, the aforementioned strip was rolled under control by adjusting hydraulic pressure of the SVC roll and the MVC roll so as to match with a component of the second power of elongation and a component of the fourth power of elongation with target values, respectively.

Figure 13:
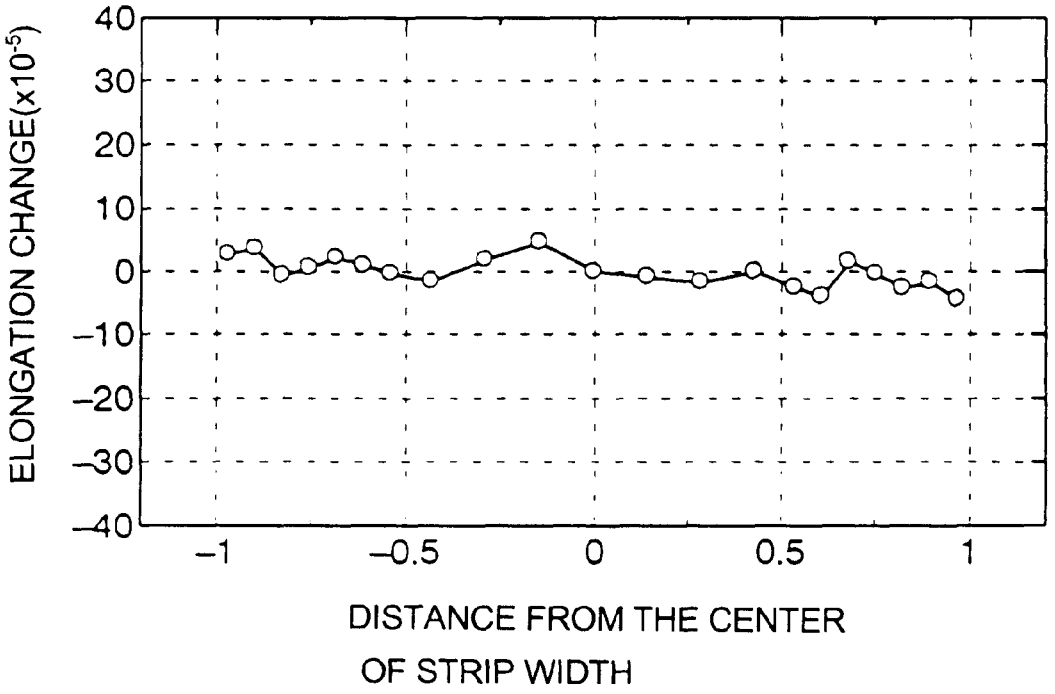
FIG. 13 is a graph showing results of shape control attained by means of an SVC roll and an MVC roll.

FIG. 13 is a graph showing results of shape control by means of an SVC roll and an MVC roll. In these graphs, the X-axis represents the distance from the center of the strip in the width direction and the Y-axis represents percent elongation. The graph clearly indicates that elongation at the quarter portions also decreased as elongation at the center and elongation at the edge portions and target uniformity in shape in the width direction was attained.

In the rolling apparatus employed in this working example, an SVC roll was employed as a lower back-up roll and an MVC roll was employed as an upper back-up roll. However, the present invention is not limited to this embodiment, and a rolling apparatus having an MVC roll as a lower back-up roll and an SVC roll as an upper back-up roll may also be used.

In the rolling apparatus employed in this working example, a variable crown roll having a single oil chamber and that having two oil chambers were employed. However, the present invention is not limited to this embodiment, and a variable crown roll having a single oil chamber and that having a plurality of oil chambers may also be used.

INDUSTRIAL APPLICABILITY

In the method according to the present invention, the strip shape in the width direction is detected and the detected strip shape is approximated by a power function which includes terms of the first, second, fourth, and sixth powers of a distance as measured from the center in the width direction. These terms are adjusted by controlling left and right pressing-down balancers, a variable crown roll having a single oil chamber, a variable crown roll having a plurality of oil chamber, and roll benders, so as to match with target values, respectively. Since shape-controlling characteristics of left and right pressing-down balancers, a variable crown roll having a single oil chamber, a variable crown roll having a plurality of oil chamber, and roll benders are well matched with these terms of the function, shape control is carried out with high precision even when a thin strip is rolled by means of a rolling apparatus employing a small-diameter work roll having a ratio of the barrel length L of a work roll to the diameter D thereof (L/D) of more than 4. Needless to say, the load of roll coolants decreases to thereby reduce failure in control response. In addition, since control by roll coolants can compensate undesirable elongation generated due to errors in a strip shape approximated by a power function, control of a stripe shape can be performed in higher precision and quality of rolled products are greatly improved.

What is claimed is:

1. A method for rolling a strip by means of a rolling mill having a pair of work rolls and a pair of back-up rolls for supporting the work rolls, wherein one back-up roll of the pair of back-up rolls is a variable crown roll having a single oil chamber, and the other back-up roll is a variable crown roll having a plurality of oil chambers; which method comprises:

detecting a strip shape in the width direction;

approximating the detected strip shape by a power function which includes terms of second and fourth powers of a distance measured from the center of the width;

adjusting the term of second power by controlling the roll crown of the variable crown roll having a single oil chamber so as to match a target value; and adjusting the term of fourth power by controlling the roll crown of the variable crown roll having a plurality of oil chambers so as to match a target value.

2. A method for rolling a strip according to claim 1, wherein the rolling mill further comprises left and right pressing-down balancers, roll benders, and roll coolants; and the power function which approximates the detected strip shape further includes terms of first and sixth powers of a distance measured from the center of the width; which method further comprises:

adjusting the term of first power by controlling the pressing-down amount of the left and right pressing-down balancers so as to match a target value;

adjusting the term of sixth power by controlling the roll bending force of the roll benders so as to match a target value; and controlling the roll coolants so as to obtain an elongation corresponding to the difference between the detected strip shape and a target shape which is approximated by the power function.

3. A method of rolling a strip according to claim 1, wherein a ratio of barrel length of the work roll L to diameter D (L/D) is more than 3.

4. A method of rolling a strip according to claim 2, wherein a ratio of barrel length of the work roll L to diameter D (L/D) is more than 3.

5. The method for rolling strip according to claim 1, wherein the strip is foil.

6. The method for rolling strip according to claim 2, wherein the strip is foil.

7. The method for rolling strip according to claim 3, wherein the strip is foil.

8. The method for rolling strip according to claim 4, wherein the strip is foil.

9. An apparatus for rolling a strip, which apparatus comprises a rolling mill, a shape meter, and a calculation and control unit, wherein the rolling mill comprises a pair of work rolls; a pair of back-up rolls for supporting the work rolls; left and right pressing-down balancers; roll benders; and roll coolants;

one back-up roll of the pair of back-up rolls is a variable crown roll having a single oil chamber and the other back-up roll is a variable crown roll having a plurality of oil chambers;

the shape meter is disposed at the entrance or exit of the rolling mill to detect a strip shape in the width direction;

the calculation and control unit approximates the strip shape detected by the shape meter by a power function which includes terms of first, second, fourth, and sixth powers of a distance measured from the center of the width;

the calculation and control unit calculates the control amount of the pressing-down amount of the left and right pressing-down balancers so as to match a target value of the term of the first power;

the control amount of the roll crown of the variable crown roll having a single oil chamber so as to match a target value of the term of the second power;

the control amount of the roll crown of the variable crown roll having a plurality of oil chambers so as to match a target value of the term of the fourth power;

the control amount of the roll bending force of the roll benders so as to match a target value of the term of sixth power; and the control amount of the roll coolants so as to obtain an elongation corresponding to the difference between the strip shape detected by the shape meter and a target shape which is approximated by the power function.

10. An apparatus for rolling a strip according to claim 9, wherein a ratio of barrel length of the work roll L to diameter D (L/D) is more than 3.

11. The apparatus for rolling strip according to claim 9, wherein the strip is foil.

12. The apparatus for rolling strip according to claim 10, wherein the strip is foil.

* * * * *

UNITED STATES PATENT AND TRADEMARK OFFICE

CERTIFICATE OF CORRECTION

PATENT NO. : 6,216,505 B1
DATED : April 17, 2001
INVENTOR(S) : Hiramatsu et al.

It is certified that error appears in the above-identified patent and that said Letters Patent is hereby corrected as shown below:

Claims 3, 4, and 10,
Should read as follows:

Claim 3. A method for rolling a strip according to claim 1, wherein a ratio of barrel length of the work roll L to diameter D (L/D) is more than 4.

Claim 4. A method for rolling a strip according to claim 2, wherein a ratio of barrel length of the work roll L to diameter D (L/D) is more than 4.

Claim 10. An apparatus for rolling a strip according to claim 9, wherein a ratio of barrel length of the work roll L to diameter D(L/D) is more than 4.

Signed and Sealed this

Eighteenth Day of December, 2001

*Attest:*

*Attesting Officer*

JAMES E. ROGAN
*Director of the United States Patent and Trademark Office*